United States Patent [19]

Burton

[11] 4,429,645

[45] Feb. 7, 1984

[54] BURNING SYSTEM AND METHOD

[76] Inventor: R. Edward Burton, 23881 Sherwood Rd., Willits, Calif. 95490

[21] Appl. No.: 376,763

[22] Filed: May 10, 1982

Related U.S. Application Data

[63] Continuation-in-part of Ser. No. 121,536, Feb. 14, 1980, Pat. No. 4,329,931.

[51] Int. Cl.[3] ..... F23G 5/12

[52] U.S. Cl. ..... 110/346; 110/109; 110/229; 110/238; 110/255; 110/257

[58] Field of Search ..... 110/229, 238, 255, 257, 110/109, 346

[56] References Cited

U.S. PATENT DOCUMENTS 3,668,077 6/1972 Ban ..... 110/257 X 3,855,950 12/1974 Hughes, Jr. et al. ..... 110/255 X

*Primary Examiner*—Edward G. Favors

*Attorney, Agent, or Firm*—Flehr, Hohbach, Test, Albritton & Herbert

[57] ABSTRACT

A substantially smokeless burning system for burning waste material fuels. An elongated hollow burning chamber is supported in a generally horizontal orientation. An elongated fuel accumulation chamber and a hydraulic hoist driven ram in the chamber are adapted to push elongated volumes of new fuel into the lower front end of the burning chamber such that already burning fuel is pushed to the rear of the chamber. This establishes a charcoal burning zone which at least partially overlies a volatile burning zone such that incomplete combustion products from the volatile burning zone pass over and through the charcoal burning zone to be substantially burned before exiting at the rear of the burning chamber. Integral preheat and air delivery channels are formed in the walls of the burning chamber. A pipe section is mounted within the burning chamber for incinerating liquid waste materials.

9 Claims, 6 Drawing Figures

BURNING SYSTEM AND METHOD

This application is a continuation-in-part of Burton U.S. application Ser. No. 121,536, filed Feb. 14, 1980, U.S. Pat. No. 4,329,931 (hereinafter referred to as "the parent Burton application").

This invention relates in general to burning systems and methods, and more specifically, to burning systems and methods for burning a variety of fuels in a substantially smokeless manner. This invention further relates to systems and methods for incinerating liquid waste materials.

In many localities there are large quantities of waste materials, such as wood scraps, bark slabs, underbrush, rice-straw, wheat-straw, etc., which could be used as fuel if a burning system were available to burn the materials in compliance with local air pollution standards. Even in rural areas, pollution control laws require that incinerators and other burning systems operate in an essentially smokeless manner and emit combustion gases of various types and particulates in concentration less than mandated levels. Most localities in the United States require that burning systems emit a level of smoke less than a Ringleman rating of 1 which means, neglecting steam and water vapor, only very slight wisps of smoke are visible to the eye. The above-mentioned materials often have a substantial moisture content and are difficult to burn without emitting substantial smoke.

The burning of unseasoned wood scraps and other fuels having a substantial water content is a three-step process that proceeds sequentially. As the fuel is brought to the ignition temperature (about 400° F. for wood), water vapor is given off as the fuel goes through a drying phase. As the fuel starts to burn, combustible gases and unburned carbon particles are given off in the form of smoke. This can be called the volatile burning phase. Later the fuel enters a charcoal phase wherein the fuel is burning at a much higher temperature and very little water vapor, combustible gases and unburned carbon are emitted. Subsequently, the fuel enters the ash phase wherein substantially all the combustible portions of the material have been burned, leaving a generally uncombustible residue.

Prior art systems have generally taken a variety of approaches to burning fuels with substantial moisture content in a substantially smokeless manner. A first approach generally involves the use of an afterburner compartment or section which the volatile gases and unburned carbon particles emanating from the burning material pass through and are substantially burned before exiting through a flue or chimney. This afterburner approach involves either a passive system in which the afterburner structure is heated by the combustion heat from the burning material itself, or is an active system utilizing supplemental fuel for burning the volatile gases and unburned carbon particles in a secondary burning process. Systems such as those disclosed in U.S. Pat. Nos. 3,456,603, 3,408,167 and 3,380,410 exemplify this afterburner approach.

A second approach involves extending the transient time of the fuel in the combustion zone, i.e., the area where the temperature in the burning chamber is above 500° F. while providing sufficient combustion air (oxygen) to the combustion zone. The second approach is exemplified by Glaeser U.S. Pat. No. 2,483,728 and Berg U.S. Pat. Nos. 2,783,776 and 2,800,093. The systems disclosed in each of these patents generally involve provision of combustion air to the burning chamber tangentially to the flow of pulverized or comminuted fuel into the chamber in order to create a swirling motion of the fuel. This results in longer transient time for the fuel in the combustion chamber, and the swirling air tends to throw unburned particles against the walls where they can then drop back into the burning zone. One of the purposes of the systems for burning waste materials is the conservation of energy resources, as well as eliminating the need for other, environmentally-unsound methods of waste disposal. The requirement that the fuel be in a comminuted or finely divided form detracts from the value of such systems since substantial energy is required for bringing most waste materials into such a finely divided form. Furthermore, the prior art systems referred to above, generally utilize a complex burning chamber and air delivery system requiring separate auxiliary ducting systems which provides the combustion air to the jet structure for producing the swirling air currents in the burning chamber.

Sheridan U.S. Pat. No. 4,172,425 discloses a burning system in which a series of reciprocating steps advance comminuted fuel into an elongated burning chamber. These fuel conveying steps require separate driving and cooling arrangments and the overall structure of the Sheridan burner is complex and expensive.

Another approach involves feeding new fuel into the burning chamber underneath the already burning fuel. This is generally accomplished by using a conveyor such as a screw conveyor to feed fuel into the bottom of a vertical burning chamber so that the volatile gases and unburned particles will be burned in passing through a vertically adjacent zone in which material is burning in a charcoal phase. Systems employing this approach in a vertical burning chamber are only partially successful since the volatile gases tend to pass quickly through the upper charcoal burning zone. Furthermore, a screw conveyor requires that the fuel be comminuted or pulverized, since other forms of fuel cannot be pushed around a bend to enter the burning chamber. Finally, a screw conveyor system involves substantial risk of flashback of the fire into the conveyor where it may ultimately reach the fuel supply and end up damaging the burning system. It can thus be seen that a simple and trouble-free, smokeless burning system is not available in the prior art.

Modern industrial civilizations also produce substantial quantities of liquid waste materials such as sewage sludge from community sewage treatment plants, organic wastes from paper and pulp mills, and inorganic waste solutions such as chromic acid solutions left over from chromium plating operations. While incineration of such liquid waste materials has long been a desirable disposal method, systems and methods for incineration have generally involved complex, expensive equipment generally requiring the use of costly petroleum or natural gas fuels. Some of the incinerations systems which have been developed are so complex that they are frequently not operational or have operational problems which preclude them from consistently achieving incineration in a manner that meets local air quality standards.

For example, among the complex incinerator systems for disposal of waste water sludge are the multiple hearth furnace, the fluidized bed reactor, the flash drying and incineration systems, and the wet air oxidation system. The general characteristics and operating principles of such systems are described in publication EPA 625/1-74-006, entiled "Process Design Manual for Sludge Treatment and Disposal", published by the Office of Technology Transfer of the U.S. Environmental Protection Agency, in October 1974. A simple and trouble-free system for incinerating a variety of liquid waste materials is not available in the prior art.

Accordingly, it is an object of this invention to provide a burning system of simple construction which can burn a variety of solid fuels in a substantially smokeless fashion.

It is a further object of this invention to provide an efficient method of burning a variety of solid fuels in uncomminuted form with a minimum of smoke.

It is a further object of this invention to provide a burning system and method which are capable of simultaneously burning a variety of solid fuels and incinerating a variety of liquid waste materials.

This invention generally features a substantially smokeless burning system which utilizes an elongated burning chamber supported in a generally horizontal orientation with a fuel entry port located substantially at a lower floor region of the front of the chamber and a combustion gas exit port at the rear end of the chamber. A gate means is mounted adjacent the fuel entry port and has a closed position blocking the fuel entry port and an open position for admitting fuel through the fuel entry port. A feeding means is provided for pushing an elongated volume of new fuel, including a substantial amount of fuel with longitudinal strength, into a lower front end of the burning chamber, simultaneously pushing previously introduced, already-burning fuel toward the rear of the burning chamber. This establishes a fuel drying zone extending across a lower front portion of the chamber, a volatile burning zone adjacent to and partially overlying the fuel drying zone in a generally central portion of the chamber, and a charcoal burning zone adjacent to and substantially overlying the volatile burning zone in a generally rear portion of the chamber. Air delivery means is provided for supplying air to the interior of the chamber at a plurality of locations across at least substantially the total length of said chamber. Incomplete combustion products from the volatile burning zone pass through and across the charcoal burning zone and are substantially completely burned therein before exiting the rear end of the chamber.

In a preferred embodiment, the burning chamber comprises a generally hollow body molded from a refractory material and the support means comprises a pair of support beams carrying the burning chamber and a support structure carrying the support rails in a generally horizontal orientation. The feeding means comprises an elongated fuel accumulation chamber which communicates with the fuel entry port of the burning chamber and is adapted to receive fuel to be burned. A feeding ram is carried in the fuel accumulation chamber and is adapted to push material therein into the burning chamber. A driving means is provided for driving the feeding ram to deliver the material into the burning chamber. In the preferred embodiment, the air delivery means comprises at least one channel formed in a wall portion of the hollow body and extending across at least substantially the total length thereof. A plurality of air delivery ports are located at intervals along substantially the total length of the channel to connect the channel with the interior of the hollow body. An external opening in the channel is adapted to be connected to an air supply means for delivering air to the interior of the hollow body through the channel and air delivery ports.

To adapt the burning system of the invention for incinerating liquid waste materials, a pipe section of substantial length is mounted in the interior of the burning chamber. An inlet end of the pipe section extends through one wall of the chamber and an outlet end is positioned in a central region of the chamber at a location above the fuel burning within the chamber and in a position higher than the inlet end. A pump means is provided for communicating liquid waste materials into the inlet end of the pipe section at a low delivery rate. In this manner the volatile constituent in the liquid waste material are substantially vaporized prior to leaving the pipe section and any solid, burnable particles in the liquid waste material are substantially dried and brought to the combustion temperature within the pipe section and then burned after exiting the pipe section.

In accordance with another aspect of this invention, a system for substantially pollution-free incineration of liquid waste materials is provided. The system includes a burning chamber for burning solid fuels and having a high temperature fuel combustion zone characterized by substantial particulate residence time within the burning chamber. A pipe section of substantial length extends into the burning chamber with an inlet end of the pipe section extending through one wall of the burning chamber and an outlet end positioned within the high temperature fuel combustion zone and with a substantial portion of the pipe section traversing the high temperature fuel combustion zone. A pump means is provided for communicating liquid waste materials into the inlet end of the pipe section at low delivery rate so that volatile constituents in the liquid waste material are vaporized prior to leaving the pipe section and solid, burnable particles in the liquid waste material are substantially dried and brought substantially to the combustion temperature within the pipe section and then burned after exiting the pipe section.

In accordance with another aspect, the invention features a method for burning combustible material with a minimum of smoke which begins with the step of disposing an elongated, substantially-closed burning chamber in a substantially horizontal orientation. A flue pipe is disposed at the rear of the burning chamber to create a draft for combustion gases from front to rear of the chamber. The next step is to furnish a continuous supply of combustion air to the interior of the burning chamber at regular intervals across the total length of the chamber. The method continues with establishing a first elongated volume of fuel burning in a substantially smokeless, charcoal burning phase across an extended lower region of the burning chamber. Next, a second elongated volume of fuel is pushed into a lower front region of the burning chamber to initiate combustion of the second volume of fuel in a volatile burning phase which produces volatile gases and unburned combustible particles and to push at least part of the first volume of fuel toward the rear of the chamber. The volatile gases and unburned combustible products from the second volume of fuel are passed through and over the first volume of fuel in the burning chamber to be substantially completely burned before exiting the burning chamber.

The general method of this invention may be adapted to incinerate liquid waste materials without substantial pollution by including the steps of disposing a pipe section of substantial length within the burning chamber with an outlet end of the pipe positioned at a location either in a front or central region of the burning chamber at a higher level than the inlet of the pipe section and then conveying the liquid waste material through the pipe section at low fluid delivery rate such that volatile constituents in the liquid waste material are vaporized prior to leaving the pipe section and any solid, burnable particles in the liquid waste materials are substantially dried and heated substantially to the combustion temperature within the pipe section and then burned after exiting the pipe section.

In accordance with another aspect of this invention, a method is provided for simultaneously incinerating solid combustible materials and liquid waste materials in a substantially pollution-free manner. The method involves disposing an elongated substantially closed burning chamber in a generally horizontal orientation. A pipe section of substantial length is disposed within the burning chamber with an outlet end positioned at a higher level than the inlet end and at a location in either a front or central region of the burning chamber with a substantial portion of the length of the pipe section extending through a high temperature zone of the chamber. Combustion air is furnished to the burning chamber at regular intervals across substantially the total length of the chamber. An elongated first volume of fluid burning in a charcoal phase is established across a charcoal burning zone comprising at least major portions of the lower central and rear regions of the burning chamber. From time to time successive elongated volumes of new fuel, including substantial fuel elements with longitudinal strength, are pushed into a lower front region of the burning chamber to initiate combustion of the new fuel in a volatile burning phase and each time to push at least a part of the first volume of fluid toward the rear of the chamber. Liquid waste materials are conveyed through the pipe section at low fluid delivery rate such that volatile constituents in the liquid waste material are substantially vaporized prior to leaving the pipe section and any solid, burnable particles in the liquid waste material are substantially dried and brought substantially to the combustion temperature within the pipe section then burned after exiting the pipe section. The combustion gases are withdrawn from the chamber at the rear end of the chamber such that volatile gases and unburned combustible particles from the volume of new fuel and from the outlet of the pipe section pass through the charcoal burning zone to be substantially completely burned before exiting the burning chamber.

The burning apparatus and method of this invention have the advantage of enabling the virtually smokeless burning of a wide variety of fuels, including a variety of waste materials such as scrap wood, underbrush, bark, sawdust, wheat straw, etc. The fuels do not have to be comminuted (i.e., pulverized or chopped up) because individual fuel charges are accumulated in an elongated feeding chamber and then rammed into the elongated burning chamber with a hydraulically driven ram. Preferably, a substantial portion of each new fuel charge or volume comprises elongated pieces of fuel with substantial longitudinal rigidity. The feeding action of such a fuel charge causes the new fuel to push the already burning fuel toward the rear of the burning chamber. This advantageously creates the two adjacent volatile and charcoal burning zones, with the charcoal burning zone partially overlying the volatile burning zone such that volatile gases and unburned particles must pass either through or over the charcoal burning zone and are thus burned in a substantially complete manner before exiting the chamber.

The burning system of this invention has a further advantage of being of simplified construction. This simplified construction is provided by the use of a burning chamber with combustion air channels integrally formed in the side walls of the chamber. In addition, as described in the parent Burton application, the burning chamber is formed by molding a plurality of pipe sections out of refractory material with the air channels integrally molded into the side walls of the pipe sections. The pipe sections can then be assembled together end-to-end with the channels substantially aligned to form this simplified burning chamber. By utilizing existing pipe section molding apparatus typically used for the molding of concrete sewer pipe sections, the burning chamber of this invention can be constructed very economically. This avoids the high labor costs involved with building burning chambers with individual bricks of refractory material. It also avoids the complexity of metal burning chambers which require surrounding water jackets to keep the chamber walls from melting. The integrally formed air delivery channels avoid the expense of labor and material in providing separate ducting structures for supplying combustion air to the interior of the chamber.

The rugged, simple construction and operation of the burning system according to this invention enables it to be readily utilized in an outdoor environment and it is especially suited for providing the large amounts of heat required in the making of asphalt paving materials or the manufacture of Portland cement. The burning system can be combined with a boiler and turbine arrangement to generate electric power or other forms of energy. The burning system can readily be operated and tended by one person and does not require any sophisticated control or automatic feeding mechanisms for maintaining optimal operation of the system.

The waste liquid incineration system and method of this invention provides a simple, effective, and inexpensive approach to disposal of otherwise troublesome waste materials such as sewage sludge and chromic acid wastes. The combination of the solid fuel burning system and liquid waste incineration feature provides a unique, low cost, substantially pollution-free approach to burning waste solid materials to recover their fuel content and simultaneously disposing of liquid wastes. This combination system may be advantageously employed as one component of the treatment and disposal system and method disclosed in the copending Burton et al application.

Other objects, features and advantages of this invention will be apparent from a consideration of the following detailed description of preferred embodiments of the various features of invention in conjunction with the accompanying drawings.

Figure 1:
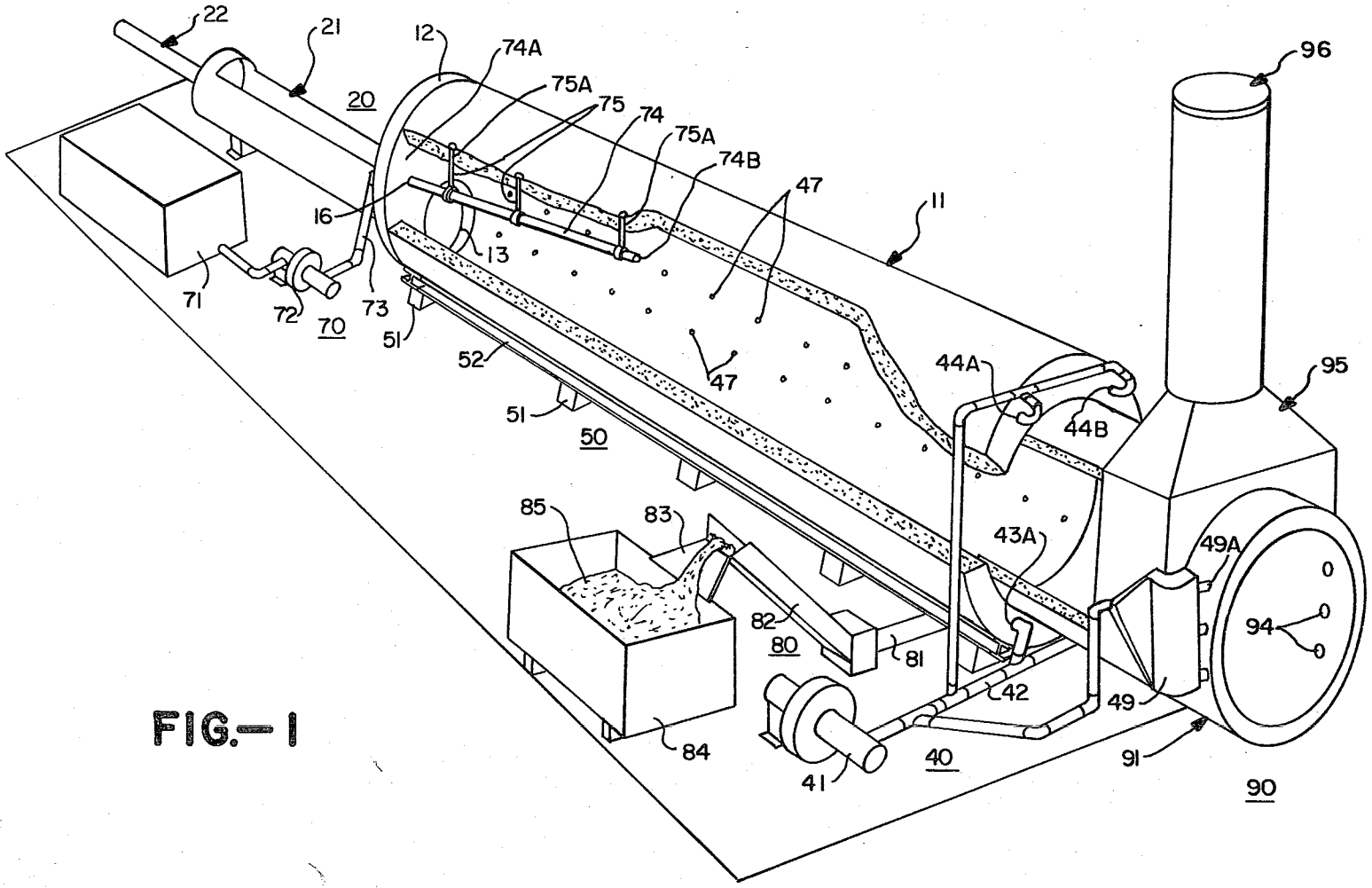
FIG. 1 is a perspective view of a burning system in accordance with this invention.

The general overall structure of a burning system in accordance with this invention is depicted in FIGS. 1–4. The major components of the preferred burning system are an elongated burning chamber 10, a fuel feeding system 20, an entry port gate arrangement 30, a combustion air delivery system 40 and a support structure 50. A shield arrangement 60 is shown on burning chamber 10 to shield it against moisture from rain or snowfall (if used outdoors) and to partly insulate the walls of the burning chamber 10 to maintain an optimum heat distribution thereacross. A transition section 90 is provided to couple burning chamber 10 to a boiler 100. Transition section 90 includes a bypass flue 95 and a hydraulically operated damper system 96. A liquid waste burning arrangement 70 is an important optional feature of the burner system of this invention.

Burning chamber 10 comprises a generally hollow cylindrical body 11, a front wall 12, and an open rear end 14. The hollow cylindrical body 11 may be made from a plurality of individual pipe sections as described in the parent Burton application. Front wall 12 has a fuel entry port 13 therein. The open rear end 14 serves as a combustion gas exit port. A small opening 15 is formed in the bottom rear of cylindrical body 11 to drop ash and charcoal into a collection system 80. The specific structural details of burning chamber 10 will be described later.

Fuel feeding arrangement 20 comprises a fuel accumulation chamber 21, a feeding ram 25 carried in fuel accumulation chamber 21 and a driving means 22 for driving the feeding ram 25. Fuel accumulation chamber 21 is an elongated, hollow cylindrical body with an elongated top opening 24 through which fuel can be placed in chamber 21. Feeding ram 25 is adapted to traverse the interior of accumulation chamber 21 to push fuel into fuel entry port 13. Driving arrangement 22 is a hydraulic cylinder with its piston 22A attached to feeding ram 25. The hydraulic cylinder is a double acting cylinder for driving feeding ram 25 toward the fuel entry port 12A and withdrawing the feeding ram 25 to the front of chamber 21.

Figure 4:
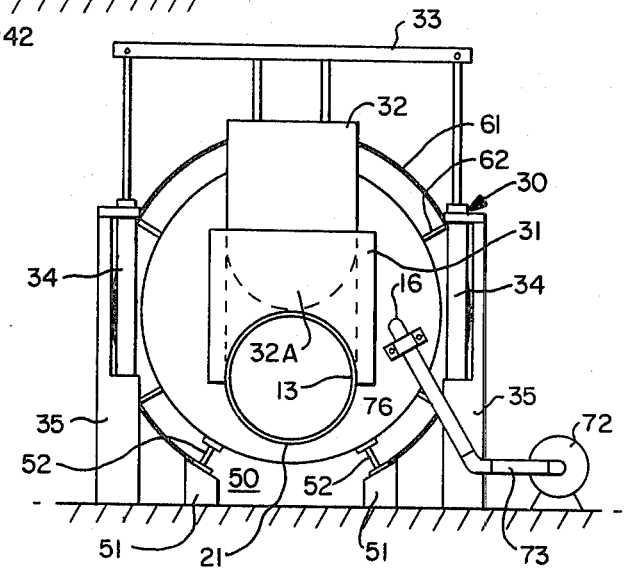
FIG. 4 is a front elevation view of the burning chamber taken along the lines 4—4 in FIG. 2.

FIG. 4 shows one embodiment of an entry port gate arrangement 30 which permits alternate blocking and unblocking of the fuel entry port 13. A gate guiding arrangement 31 of any suitable construction is mounted either to the fuel accumulation chamber 21 or to the front wall 12 of the burning chamber 10 to provide a guiding channel for the gate element 32. Gate 32 is preferably formed of refractory material and has a semicircular bottom section 32A of a radius matching the internal radius of the fuel accumulation chamber 21. A lifting bar 33 cooperates with a pair of hydraulic cylinders 34 to raise and lower the gate 32. In FIG. 4 the gate is shown in its raised position unblocking the fuel entry port 13. When hydraulic cylinders 34 are operated to lower gate 32, it will assume a blocking position within the fuel accumulation chamber 21. The hydraulic cylinders 34 are supported utilizing suitable support and bracket structures such as the arrangement 35 shown in FIG. 4. It should be understood that numerous different approaches could be utilized to provide a entry port gate arrangement on the front of burning chamber 11.

Gate 32 is normally maintained in its lower, fuel entry port blocking position to prevent fugitive emission of combustion gases and unburned particulates from the interior of burning chamber 10. Gate 32 is raised each time a new fuel charge is to be introduced into burning chamber 10 by ram 25. It should be apparent that hydraulic generators (not shown) and control units (not shown) for operating the hydraulic cylinders 34 to raise and lower the entry port gate 32 and for operating the cylinder 22 to push a volume of fuel into the burning chamber would be provided. Such a control system should include a safety lockout feature which precludes operation of the fuel feeding hydraulic cylinder except when the entry port gate 32 is its raised position. An automatic sequencer could also be provided which responds to a single manual input control signal to operate hydraulic cylinders 34 to raise the entry port gate 32 followed by automatically sequencing the operation of the fuel feeding cylinder 22 to push a new volume of fuel into chamber 11 and then to withdraw, followed by the closing of the entry port gate 32 after the fuel feeding ram 25 has cleared the gate area on the retracting stroke of the driving cylinder 22.

Combustion air delivery system 40 generally comprises four pairs of substantially closed channels or ducts 43, 44, 45, and 46 formed in the side walls of the hollow cylinder body 11 of burning changer 10, plenums 48 formed at the front of hollow body 11 to connect adjacent ducts, air delivery ducting 41 communicating with ducts 43–46 and an air blower 41 for supplying air to the ducting 41. In operation of the burning system, the air delivered by blower 41 is preheated in ducts 43 and 44 as it flows from the rear to the front of the burning chamber walls. This preheated air is delivered through plenums 48 to ducts 45 and 46. The preheated air will then flow through air delivery ports 47 to provide overfire air to burning chamber 10.

A preferred support structure 50 comprises a plurality of pylons 50 and supporting a pair of I-beams 52 with burning chamber 10 resting on I-beams 52. With this support arrangement the hollow body 11 is free to expand and contract longitudinally and radially during heat-up and cool-down cycles.

Figure 5:
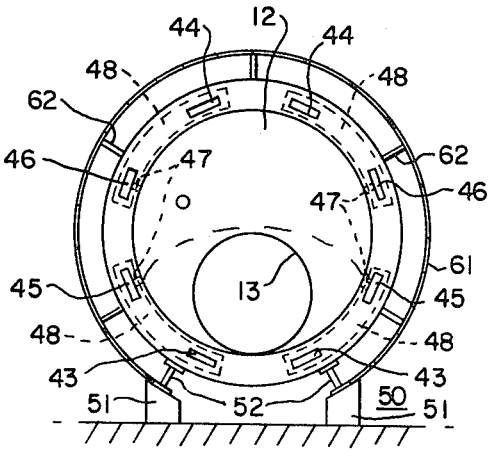
FIG. 5 is a partial section view taken along the lines 5—5 in FIG. 2.
Figure 6:
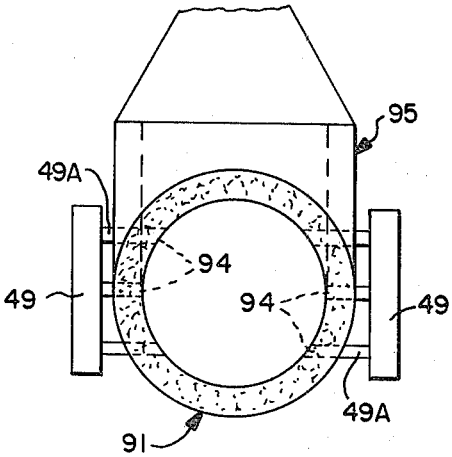
FIG. 6 is a section view taken along the lines 6—6 in FIG. 2.

Shield arrangement 60 includes a hollow cylindrical side wall section 61 which surrounds a major portion of the exterior of burning chamber 10. In particular, as shown in FIG. 5, this cylindrical side wall section 61 extends from support beams 52 around the side and upper wall portions of burning chamber 10. A plurality of supports 62 maintain the spacing between side wall section 61 of shield and the outer surface of hollow body 11. The front and rear ends may be sealed with wall sections to form a closed insulating chamber surrounding the major portion of burning chamber 10. The rear end of burning chamber 10 preferably extends into a substantially enclosed building which houses transition section 90 and boiler 100 as well as any steam utilization means operated by steam from boiler 100.

Figure 2:
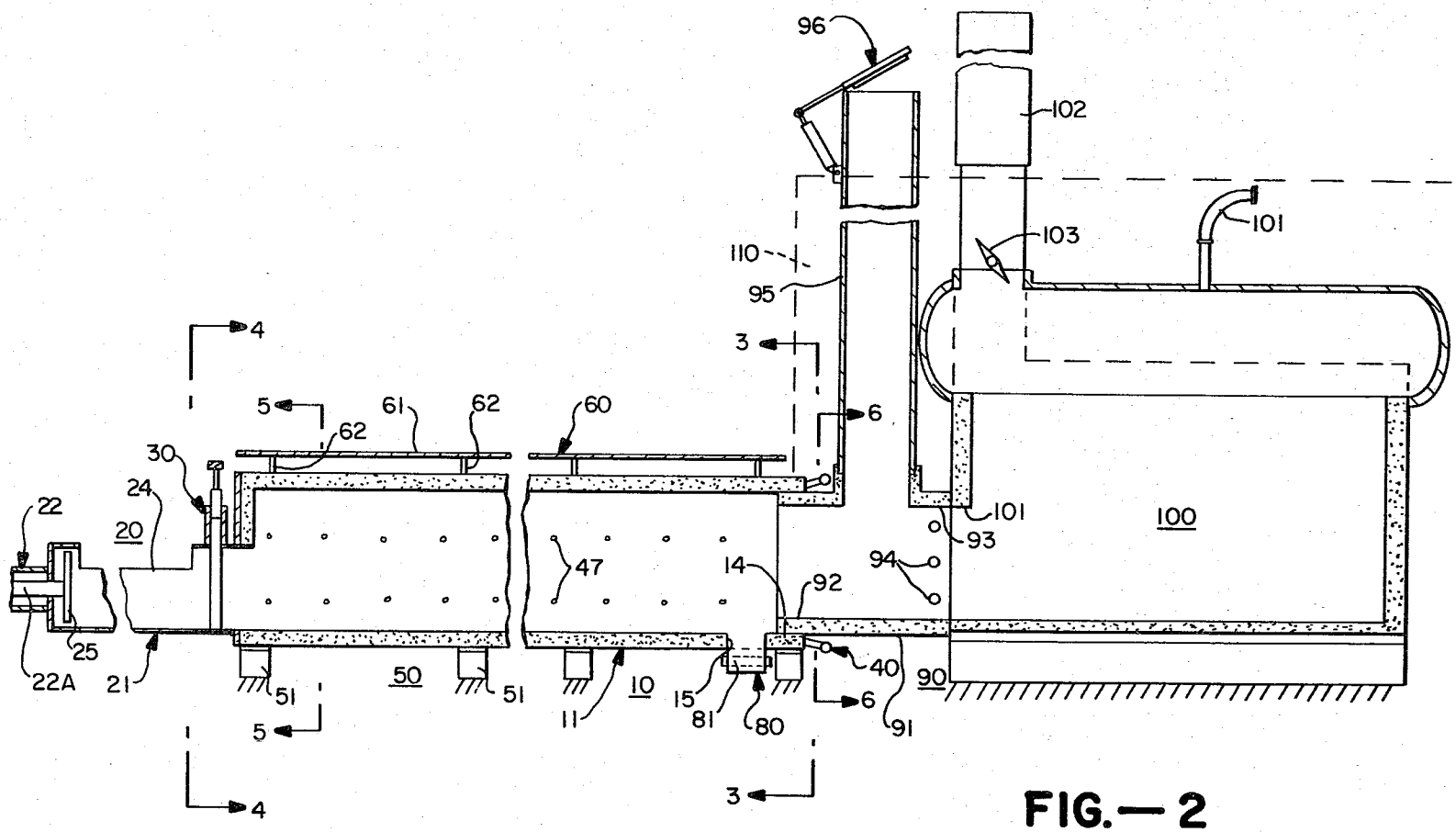
FIG. 2 is a cross-section view of a burning system in accordance with this invention.
Figure 3:
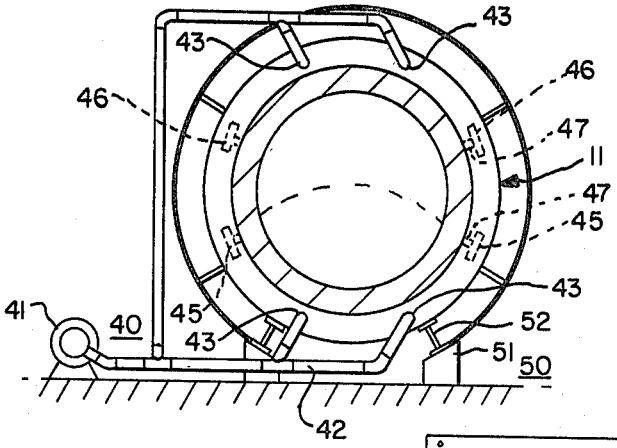
FIG. 3 is a rear elevation view taken along the lines 2—2 in FIG. 2.

FIG. 2 shows a transition burner section 90 with a by-pass flue and damper arrangement for communicating heated air from the burning chamber 10 into a boiler 100 with optional by-pass of the boiler 100 by opening the damper 96 on by-pass stack 95. The transition chamber 90 generally comprises a hollow cylindrical pipe section 91 having an outer diameter corresponding substantially to the inner diameter of burning chamber 11 so that the front 92 of pipe section 91 telescopes into the rear 14 of chamber 11. This permits movement between the cylindrical walls of the transition pipe section 91 and the cylindrical burner section 11 as the walls of these sections expand and contract during heat-up and cool-down of the burning system. The rear end 93 of the transition pipe section 91 is mounted to an entry port 101 of the boiler 100. Any appropriate mounting arrangement may be utilized at this location. For example the transition pipe section 91 may be clad with a cylindrical steel jacket having a flange thereon which enables the rear of section 93 to be bolted to the front wall of boiler 100.

As particularly shown in FIG. 1, secondary combustion air may be furnished to the transition section 90 by a plenum arrangement 49 with ducts 49A extending through holes 94 in the rear section 93 of the transition pipe section 91.

The boiler 100 includes a flue 102 with a damper 103 mounted therewith. The damper 103 may be actuated either manually or automatically. Together with the damper 96 on the by-pass flue 95, the damper 103 controls whether heated air from the burning chamber 10 passes through the boiler and into the flue 102 or passes out the by-pass flue 95 for shutting down of the boiler 100. The boiler 100 is preferably a dual pass boiler arrangement of relatively standard construction. The steam outlet 101 of boiler 100 may be coupled to a steam turbine which in turn may drive a generator to generate electricity. Alternatively, the turbine may drive machinery or operate a compressor to store energy in the form of compressed gas.

FIG. 1 shows an ash removal system which may be utilized to remove charcoal and ash which drops through the opening 15 (FIG. 2) in the bottom rear of the combustion chamber 10. A pair of ash conveyors 81 and 82 may be provided to convey the ash from the burning chamber to a chute 83 leading to an ash container 84. The ash 85 accumulated within chamber 84 may be removed and disposed of in any suitable fashion.

An important feature of the burning system and method of this invention involves the provision of the liquid waste incineration system 70 which is capable of providing virtually pollution-free disposal of a variety of liquid waste material such as sewage sludge and chromic acid wastes from chrome plating operations and the like. As shown in FIG. 1, one embodiment of such a liquid waste disposal feature includes a liquid waste heating pipe 74 mounted within the burning chamber 10, a liquid waste storage tank 71 and a pump 72 for conveying liquid waste materials from tank 71 through delivery piping 73 to the burning pipe 74. Heating pipe 74 is supported within burning chamber 10 by pipe hangers 75 whose top ends 75A are suitably anchored to the top wall section of the hollow body 11. The inlet 74A of heating pipe 74 extends through an aperture 16 formed in the front wall 12 of burning chamber 10. A bracket 76 (FIG. 4) may be used to hold the pipe section 74 in position. The outlet 74B of the pipe section 74 is positioned within chamber 10 at a level above the inlet section 74A. Preferably, as shown in FIG. 4, the aperture 16 through which the pipe section 74 extends is formed in the front wall 12 next to the guide arrangement 31 for the entry port gate 32 and the pipe section 74 is angled upward and inward from that entry point toward the center of the burning chamber.

The pipe section 74 and the pipe hangers 75 are preferably formed of a high temperature alloy such as Inconel which will withstand temperatures up to about 1800° F. without melting. This enables the pipe section 74 to withstand the internal temperatures of burning chamber 10. Pipe section 74 may for example be of a length equal to about one third the length of the burning chamber 10. Accordingly, for a burning chamber thirty feet long, a pipe section of about ten to twelve feet in length may be utilized. The diameter of pipe section 74 is conveniently about one and one-half inches since a relatively low rate of fluid delivery through the pipe section is desirable.

The operation of this liquid waste burning system involves operating pump 72 to deliver liquid waste material to the burning pipe 74 at a delivery rate of up to about five gallons per minute. For example, the liquid waste material may be sewage sludge at a solids concentration in the range of three to fifteen percent, as the slurry of sludge enters heating pipe 74, the water in the slurry is turns to steam as the material traverses the initial length of the pipe section. By the time the material reaches the end of pipe section 74 the sludge solids have been substantially dried and tend to collect in the outlet end of the pipe section. The water which has been evaporated from the slurry exits the outlets 74B of the pipe section into the interior of burning chamber 10. Gradually the solids build up in the outlet end 74B of the pipe section 74 until they clog the outlet. Shortly thereafter a head of steam builds up in the pipe section 74 behind the clog. Eventually the pressure of this steam forces the clogged solids out of the outlet 74B of the pipe section into the interior of the burning chamber. Prior to exiting the pipe 74, the temperature of the solids has been raised substantially to the combustion temperature of the organic wastes contained in the solids. Substantially total burning of these solids then occurs in the volatile and charcoal zones of the burning chamber, thus producing a pollution-free incineration of the solids.

Chromic acid wastes can be incinerated in substantially the same fashion. As is well-known, chromic acid wastes contain substantial quantities of hexavalent chromium ($CrO_3$) which is toxic. In passing through the pipe 74 the chromic oxide waste is substantially heated before entering the burning chamber. For example, the vaporized chromic acid waste will leave the outlet of burning pipe 74 at a temperature somewhere in the range of 1000–1200° F. At this temperature and in the presence of oxygen, the hexavalent chrome is converted to trivalent chrome ($CrO_2$) which exists in nature and is not known to be toxic.

The liquid waste disposal system of this invention thus provides a simple and convenient way of incinerating a variety of liquid waste materials, including those which do and do not contain combustible solids. It should be apparent that this liquid waste disposal feature of this invention could also be employed in the embodiment of a burning system disclosed in a parent application. It should also be apparent that the general features of this liquid waste disposal system could be deployed in other burning systems which employ a burning chamber having a substantial residence time for particulates in a high temperature zone of the chamber. It should further be understood that the pipe section 74 does not have to be a straight pipe section but could be permitted to curve or spiral. It should also be understood that the pipe section 74 could be positioned in a variety of alternative locations within the burning chamber 10. Multiple individual sections extending into the burner could also be employed. Separate pumping systems for each pipe may be used, if necessary. For example, the pipe section 74 could enter the burning chamber at the rear wall or through one of the side walls of the burning chamber 10. The outlet 74B of the liquid burning pipe 74 should, however, be positioned within the burning chamber at a location where any solid combustible particulates exiting the outlet 74B will have to traverse a substantial length of the charcoal burning zone of the chamber before reaching the combustion gas outlet so that substantially complete incineration of these combustible particulates will occur within the chamber.

Referring to FIG. 5 the specific structural details of a preferred burning chamber and shield arrangement will be described. Burning chamber 10 is a hollow cylindrical body 11 which is preferably molded from a preselected refractory material such as a castable hydraulic setting refractory concrete sold by Kaiser Refractory Materials under the trade name Sakonite.

A pair of air delivery ducts 46 are shown formed in opposite upper side wall portions of the cylindrical body 11. These ducts extend the complete length of hollow body 11 from front to rear. Air delivery ports 47 are formed between the interior of hollow body 11 and channels 46. A second set of channels 44 are formed in another upper wall section of hollow body 11 and similarly extend the full length of burning chamber. Channels 44 serve as air preheating channels and communicate with air delivery channels 46 via plenums 48 formed in a front end wall of the burning chamber 10. Plenums 48 may be constructed by forming channels in the end section of burner side walls which are covered by the front wall 12. During operation of burning chamber 10, the heat in the walls of body 11 preheats the air flowing through the channels 44. This preheated air is communicated to the combustion air delivery channels 46 and finally into the interior of combustion chamber 10 through the air delivery ports 47. In this fashion, the combustion air delivery system, comprising the preheating channels and the return combustion air delivery channels, is integrally formed in the walls of the hollow body 11 itself.

As shown in FIG. 5, additional air delivery channels 45 may be formed in a lower wall section of cylindrical body 11 with air delivery ports 47 communicating between channels 45 and the interior of hollow body 11. In this case, a separate set of preheat channels 43 may also be provided in a lower wall section of body 11 in order to carry air from one end of the burning chamber to the other to be preheated before being communicated via plenums 48 to air delivery channels 45. The air delivery ports 47 associated with air delivery ducts 45 are located slightly above the burning mass of fuel within the chamber. Thus all of the air delivery ports provide overfire air to assist in achieving efficient combustion within the burning chamber.

The specific details of a preferred shield arrangement 60 and a preferred structure and mounting arrangement for front wall 12 are set forth in the parent Burton application and are incorporated herein by reference. Similarly, the details of a preferred method for forming burning chamber 11 are set forth in the parent Burton application and are incorporated herein by reference.

From this description of the structure of a preferred form of burning chamber 10, it will be appreciated that a highly simplified and very advantageous burning chamber has been provided. The provision of combustion air ducting channels integral in the hollow cylindrical walls of the burning chamber eliminates the need for separate ducting elements to be carried on the external walls of the burning chamber. Moreover, by forming the preheating air channels 43 and 44 in the walls of the burning chamber, the efficiency of preheating the combustion air is substantially enhanced over the preheating which would be provided in ducting arrangements carried on external walls of a burning chamber. While such an improved burning chamber construction is particularly ideally suited for the overall burning system depicted in FIGS. 1–4, it should be apparent that its general structural features could also be utilized in other burning systems which can advantageously employ combustion air delivered at regular points throughout the length of the burning chamber.

The specific structural details of the principal elements of fuel feeding system 20 are set forth in the parent application and are incorporated herein by reference. The hinged cover and cover closing arrangement which are disclosed in the parent application are preferably not employed in the burner system disclosed herein, but it should be understood that they could be included if desired.

The burning system illustrated in FIGS. 1–6 may be constructed in a variety of sizes. A system has been constructed with a five-foot internal diameter for the burning chamber and utilizing four eight-foot refractory pipe sections for a total burning chamber length of about thirty-two feet. The burning chamber has walls six inches thick and two-inch by four-inch rectangular channels were formed in the six-inch walls as the preheating channels and combustion air delivery channels. The individual air delivery ports communicating between the air delivery channel and the interior of the chamber are approximately one and one-half inches in diameter with a ten inch center-to-center spacing between individual ports. A cylindrical shield with its interior walls spaced about six inches from the exterior walls of the burning chamber was provided for the sixty-inch unit. The fuel accumulation chamber for the sixty-inch unit has a diameter of about thirty inches and a length of about thirteen feet. This size burning system is capable of burning about 1400 pounds of solid organic waste material such as limbs and brush to produce about twelve million BTU's of heat per hour. With this heat generating capacity, the system can generate up to 500 kilowatts of electricity using an appropriate boiler and turbine arrangement.

It is believed that the dimensions of the burning system can be scaled to provide a system of virtually any desired size. While there are no critical relations among the various dimensions of the burning chamber and the fuel accumulation chamber, it appears that optimum operation of the burning chamber is produced when the chamber length is at least about five times greater than the chamber diameter. Also, for optimum operation, it appears that the fuel accumulation chamber should be at least about one-third the length of the burning chamber and the diameter of the fuel accumulation chamber should be no more than about one-half the internal diameter of the burning chamber.

A typical start-up and feeding operation for the burning system of this invention is as follows. First a small starting fire is built in the rear end of the fuel accumulation chamber 21 near the closed gate 32. This small starting fire can be built of newspaper and dry kindling wood. Once this starting fire is burning strongly, gate 32 is lifted and the fuel feeding ram 25 is operated to ram the starting fire into the front portion of the burning chamber 10. Next, the fuel accumulation chamber 21 is filled with a low moisture content fuel, such as dry wood. This fuel charge is preferably soaked in an auxiliary fuel, such as diesel fuel, and then pushed by the feeding ram into the burning chamber. The small starting fire quickly ignites the diesel fuel soaked wood. Two additional charges of diesel fuel soaked wood are rammed into the burning chamber about three to four minutes apart. These first three fuel charges light very quickly and within about ten minutes establish a relatively smokeless charcoal fire in the lower front section of the burning chamber. During the start-up process and thereafter, overfire air is provided to the interior of burning chamber through each combustion air entry port at a flow rate of about 3200 cubic feet per minute.

Once this initial charcoal phase fire has been established, an additional three charges of fuel are pushed into the burning chamber. This moves the charcoal burning zone toward the rear end of the burning chamber and establishes a volatile burning zone in a central region of the chamber and a fuel drying zone generally located in the front lower section of the burning chamber. Generally, about twenty minutes are allowed to elapse before the next series of three fuel charges are pushed into the burning chamber. During this interval, the relative sizes and positions of the charcoal burning zone and the volatile burning zone will change as material in the volatile burning zone enters the charcoal burning phase and more and more of the new fuel in the fuel drying zone I starts to burn. Consequently, both the charcoal burning zone and the volatile burning zone will gradually extend closer and closer to the front of the burning chamber. Each time a new sequence of three fuel charges is pushed into the chamber, the volatile burning zone and the charcoal burning zone are again pushed toward the rear of the chamber. Some of the charcoal and ash in the charcoal burning zone are pushed far enough to the rear of the chamber to drop through the opening 15 in the bottom rear section of the chamber and be collected by the ash accumulation system 80.

It is believed that four factors in the design of a burning system according to this invention are responsible for the successful burning of even high moisture content fuel in a substantially smokeless manner which meets all air pollution standards. One of the factors is the provision of the elongated burning chamber. A second factor is the provision of gate arrangement 30 and flue arrangement (95 or 102) to cause volatile gases and unburned particulates to exit at the rear of the burning chamber. The third is the provision of a feeding system for pushing an elongated volume of fuel (i.e. fuel with overall longitudinal strength) into the elongated burning chamber to advance fuel within the chamber. The fourth is the provision of preheated combustion air along the total length of the chamber. It is believed that these four factors permit the formation of the respective volatile and charcoal burning zones in the chamber, both supported throughout with overfire air, such that virtually all volatile gases and unburned particulates from newly burning fuel in the volatile burning zone are completely burned in passing through or over the charcoal burning zone before exiting the chamber.

Skilled persons in the art will appreciate that a number of alternative approaches could be taken to some aspects of the burning system and method of this invention. For example, the burning chamber 10 shown in FIG. 1 could be constructed of a steel cylindrical chamber with appropriate cooling water jackets to prevent the steel from melting during operation of the chamber. In such an arrangement a pressurized water system would be required to achieve sufficient cooling without reducing wall temperatures too much. Thus the molded refractory approach is much preferred. External ducting could be provided for supplying the combustion supporting air to the interior of the chamber. In addition, instead of an integrally formed burning chamber, such as described above, the burning chamber could be constructed of individual bricks of refractory material formed into an appropriate elongated burning chamber. It will be appreciated that these approaches do not provide all of the advantages of the preferred burning chamber construction, but such approaches would generally implement the basic principles of this invention.

With respect to the fuel feeding system, approaches other than the use of a hydraulic hoist to operate the feeding ram could be employed. For example, a screw drive arrangement could be utilized to operate the fuel feeding ram traversing the fuel accumulation chamber 21. A variety of approaches could be taken to supporting the overall burning system; however, the one disclosed is preferred since it permits a longitudinal expansion of the burning chamber during initial start-up heating of the chamber and also provides for radial expansion of the chamber without creating any stresses in the support structure. It should also be apparent that the profile of the burning chamber and the fuel accumulation chamber need not necessarily be circular and other closed profiles could be employed, such as an elliptical shape, for example. The circular profile is preferred from the standpoint of ease of forming the burning chamber by molding in the concrete pipe process mentioned above. It should thus be understood that, while preferred versions of the apparatus and method of this invention have been set forth in detail, numerous modifications could be made therein by those of skill in the art without departing from the scope of the invention as claimed.

What is claimed is:

1. A substantially smokeless burning system comprising:

an elongated burning chamber having a front, fuel entry end with a fuel entry port located substantially at a lower floor region of said chamber and a rear, combustion gas exit end;

gate means mounted adjacent said fuel entry port and having a closed position blocking said fuel entry port and an open position for admitting fuel through said fuel entry port;

support means for supporting said burning chamber in a generally horizontal orientation;

feeding means for pushing an elongated volume of new fuel into said fuel entry port, thereby pushing already burning fuel generally toward said rear end of said burning chamber to establish a fuel drying zone extending across a lower front portion of said chamber, a volatile burning zone adjacent to and at least partially overlying said fuel drying zone in a generally lower central portion of said chamber, and a charcoal burning zone in a generally lower rear portion of said chamber adjacent to and at least partially overlying said volatile burning zone; and air delivery means for supplying air to the interior of said chamber at a plurality of locations across at least substantially the total length of said chamber; whereby incomplete combustion products from said volatile burning zone pass through and across said charcoal burning zone and are substantially completely burned in said charcoal burning zone before exiting at said rear end of said burning chamber;

said burning chamber comprising a generally hollow body molded from a refractory material; said feeding means comprising an elongated fuel accumulation chamber communicating with said fuel entry ports and adapted to receive fuel to be burned, a feeding ram carried in said fuel accumulation chamber and adapted to push material therein into said burning chamber, and driving means for driving said feeding ram; and said air delivery means comprising at least one duct integrally formed in an upper wall portion of said hollow body and extending across at least substantially the total length of said body, and a plurality of air delivery ports located at intervals along substantially the total length of said channel to connect said passageway with the interior of said hollow body, said duct being adapted to be connected to an air supply means for deliverying air to the interior of said hollow body through said channel and said air delivery ports.

2. A burning system as claimed in claim 1, wherein said duct and said air delivery ports are located in an upper side wall portion of said hollow body for delivering combustion air substantially over the burning fire in said chamber; and said air delivery means further comprises at least a second duct integrally formed in a wall portion of said hollow body and extending across at least substantially the entire length of said body, and a plenum connecting one end of said second duct with said first duct, said second duct being adapted to be connected to said air supply means to receive air to be preheated as it passes through said second duct and through said plenum into said first duct.

3. A burning system as claimed in claim 1, further comprising a pipe section of substantial length extending into the interior of said burning chamber with an inlet end extending through one wall of said chamber and an outlet end positioned in a central region of said chamber at a location above the fuel burning within said chamber and in a position higher than said inlet end; and pump means for communicating liquid waste materials into said inlet end of said pipe section at a low delivery rate, whereby volatile constituents in said liquid waste material are substantially heated and vaporized prior to leaving said pipe section and any solid, burnable particles in said liquid waste material are substantially dried and brought to the combustion temperature within said pipe section and then substantially completely burned after exiting said pipe section.

4. A burning system as claimed in claim 3, wherein said elongated burning chamber has a length of at least about thirty feet, said pipe section comprises a straight section of pipe having a length of at least about ten feet, said inlet end of said pipe section extending through said front wall of said burning chamber at at preselected position above the level of the top of said fuel entry port and being fastened to said front end of said chamber; and further comprising means suspending said pipe section within said burning chamber with a prearranged degree of upward tilt from front to rear.

5. A substantially smokeless burning system comprising:

a burning chamber including an elongated hollow cylindrical body formed from a plurality of molded cylindrical sections of a refractory material positioned end-to-end with front wall mounted over one end of said cylindrical body, said front wall having a circular fuel entry port in a bottom region thereof with a diameter substantially less than the internal diameter of said burning chamber;

a fuel feeding system including an elongated hollow fuel accumulation chamber having an open rear end communicating with said fuel entry port and adapted to receive fuel to be burned, a sliding gate mounted over said fuel entry port and having a normal closed position blocking said port and an open position providing access to said port, a feeding ram carried in said fuel accumulation chamber and adapted to push fuel therein into said burning chamber through said fuel entry port, ram driving means for driving said feeding ram, and gate driving means for driving said gate;

an air delivery system including at least one duct molded into a side wall portion of said cylindrical body and extending across at least substantially the total length of said body, a plurality of air delivery ports located at intervals along substantially the total length of said duct to connect said duct with the interior of said cylindrical body and an external opening to said duct adapted to be connected to an air supply means for delivering air to the interior of said hollow cylindrical body through said passageways and said air delivery ports;

a support arrangement including at least a pair of support beams carrying said burning chamber and said fuel feeding system, and a support structure carrying said support beams in a generally horizontal orientation;

a transition chamber section having a front end telescopically extending into the rear end of said burning chamber and including a by-pass flue and damper arrangement in a top section thereof; and a boiler chamber positioned at the rear end of said transition chamber section, including a steam boiler and a primary combustion gas flue receiving combustion gases from said burning chamber after traversing said boiler.

6. In a system for substantially pollution-free incineration of liquid waste materials, a burning chamber for burning solid fuels and having a high-temperature fuel combustion zone characterized by substantial particulate residence time;

a pipe section of substantial length extending into said burning chamber with an inlet end extending through one wall of said burning chamber and an outlet and positioned within said high-temperature combustion zone; and pump means for communicating liquid waste material into said inlet end of said pipe section at low delivery rate, whereby volatile constituents in said liquid waste material are vaporized prior to leaving said pipe section and any solid, burnable particles in said liquid waste material are substantially dried and brought substantially to the combustion temperature within said pipe section and then burned after exiting said pipe section.

7. In a system for substantially pollution-free incineration of liquid waste materials, an elongated burning chamber disposed in a substantially horizontal orientation and having a front fuel entry port and a rear combustion gas exit port and containing fuel burning in a charcoal phase extending across at least a major rear region of said chamber;

a pipe section of substantial length extending through said chamber with an inlet end extending through one wall of said chamber and an outlet end positioned either in front of said charcoal phase region or in a front portion of said charcoal phase region at a level above said burning fuel and at least slightly above said inlet end thereof; and pumping means for communicating liquid waste materials into said inlet end of said pipe section at low delivery rate, whereby volatile constituents in said liquid waste material are vaporized prior to leaving said pipe section and any solid, burnable particles in said liquid waste material are substantially dried and brought substantially to the combustion temperature within said pipe section and then burned while traversing said charcoal phase region after exiting said pipe section.

8. A method for burning a combustible material with a minimum of smoke comprising the steps of:

(a) disposing an elongated substantially closed burning chamber in a substantially horizontal orientation;

(b) disposing of a flue pipe at the rear of said burning chamber to create a draft for combustion gases from front to rear of said chamber;

(c) furnishing combustion air to said burning chamber at regular intervals across substantially the total length of said burning chamber;

(d) establishing a first elongated volume of fuel burning in a charcoal phase across an extended lower front and central region of said burning chamber;

(e) pushing a second elongated volume of fuel into a lower front region of said burning chamber to initiate combustion of said second volume of fuel in a volatile burning phase which produces volatile gases and unburned combustible particles and to push at least part of said first volume of fuel toward the rear of said chamber; and (f) passing said volatile gases and unburned combustible particles through and across said first volume of material to be substantially completely burned before exiting at the rear end of said burning chamber; said method being adapted to incinerate liquid waste material in a substantially pollution-free manner and further including the steps of:

disposing a pipe section of substantial length within said burning chamber with an outlet end of said pipe positioned at a location in either a front or central region of said burning chamber at a level higher than the inlet of said pipe section; and conveying said liquid waste material through said pipe section at a low fluid delivery rate such that volatile constituents in said liquid waste material are vaporized prior to leaving said pipe section and any solid, burnable particles in said liquid waste material are substantially dried and brought substantially to the combustion temperature within said pipe section and then burned after exiting said pipe section.

9. In a method for simultaneous incineration of solid combustible materials and liquid waste materials in a substantially pollution-free manner, the steps of:

(a) disposing an elongated substantially closed burning chamber in a generally horizontal orientation;

(b) disposing a pipe section of substantial length within said burning chamber with an outlet end positioned at a higher level than the inlet end thereof and positioned at a location in either the front or central region of said burning chamber;

(c) furnishing combustion air to said burning chamber at regular intervals across substantially the total length of said burning chamber;

(d) establishing an elongated first volume of fuel burning in a charcoal phase across a charcoal burning zone comprising at least a major portion of the lower central and rear portion of said burning chamber;

(e) pushing from time-to-time a successive elongated volumes of new fuel into a lower front region of said burning chamber to initiate combustion of said volume of new fuel in a volatile burning phase which produces volatile gases and unburned combustible particles and each time pushing at least a part of said first volume of fuel toward the rear of said chamber;

(f) conveying liquid waste materials through said pipe section at a low fluid delivery rate such that volatile constituents in said liquid waste material are substantially vaporized prior to leaving said pipe section and any solid, burnable particles in said liquid waste material are substantially dried and brought substantially to the combustion temperature within said pipe section and then burned after exiting said pipe section; and (g) withdrawing combustion gases from said chamber at the rear end of said chamber such that volatile gases and unburned combustible particles from said volume of new fuel and from said outlet of said pipe section pass through said charcoal burning zone to be substantially completely burned before exiting said burning chamber.

* * * * *